US007597401B2

(12) United States Patent
Rothery

(10) Patent No.: US 7,597,401 B2
(45) Date of Patent: Oct. 6, 2009

(54) NON-MOTORIZED GOLD MINING APPARATUS

(76) Inventor: Brian Rothery, 5405 Whitney Blvd., Rocklin, CA (US) 95677

( * ) Notice: Subject to any disclaimer, the term of this patent is extended or adjusted under 35 U.S.C. 154(b) by 323 days.

(21) Appl. No.: 11/706,492

(22) Filed: Feb. 15, 2007

(65) Prior Publication Data

US 2008/0197689 A1 Aug. 21, 2008

(51) Int. Cl.
*E21C 41/22* (2006.01)

(52) U.S. Cl. ..... 299/8; 299/9

(58) Field of Classification Search ..... 299/8, 299/9

See application file for complete search history.

(56) References Cited

U.S. PATENT DOCUMENTS

| | | | | |
|---|---|---|---|---|
| 539,463 | A * | 5/1895 | Whaler | 299/9 |
| 906,234 | A | 12/1908 | Jackson | |
| 1,490,016 | A | 4/1924 | Mackenzie | |
| 1,596,448 | A | 8/1926 | Parker | |
| 2,073,122 | A * | 3/1937 | Silke | 299/8 |
| 2,756,977 | A | 7/1956 | Temple | |
| 3,558,043 | A * | 1/1971 | Smith et al. | 494/38 |
| 3,950,246 | A * | 4/1976 | Klefisch | 209/44 |
| 4,264,105 | A * | 4/1981 | Thompson | 299/9 |
| 4,367,989 | A | 1/1983 | Smith | |
| 4,494,986 | A | 1/1985 | Forsman | |

* cited by examiner

*Primary Examiner*—John Kreck
(74) *Attorney, Agent, or Firm*—Edwin Tarver; Lauson & Tarver LLP

(57) ABSTRACT

A non-motorized apparatus for collecting particulate materials, including gold, in stream placer deposits, comprising a first tubular member, a second tubular member, a third tubular member with perforated ridges, a skirt for enveloping the tubular members, and a fibrous matting disposed over the third tubular member. The third tubular member with the fibrous matting is held entirely inside the second tubular member. The second tubular member is connected to one end of the first tubular member in a way to have high velocity stream flowing into the first tubular member, creating a suction pressure in the second tubular member. The particulate matter settles in grooves formed by the ridges in the third tubular member and passes through the perforations to be trapped in the fibrous matting as the stream is sucked into the second tubular member.

17 Claims, 4 Drawing Sheets

NON-MOTORIZED GOLD MINING APPARATUS

CROSS-REFERENCE TO RELATED APPLICATION

None

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The present invention relates in general to mining apparatuses, and more particularly to a non-motorized gold mining apparatus for mining gold from stream placer deposits.

A variety of apparatuses for extracting fine particulate matter, including gold and other valuable materials, from streams, rivers or rock crevices have been developed in the art. U.S. Pat. No. 2,756,977 to Temple discloses a device for recovering gold from streams. The device includes a tubular conveyor comprising digging means in the form of teeth or plates at the lower end and a centrally disposed water line and air pressure line for discharging pressurized water and air to the digging member. The water and air discharged to the digging member is then adapted to move upwards through the conveyor for delivering into the collector receptacle where the water is discharged through the plurality of openings and heavy metals settle in the lower portion of the collector.

U.S. Pat. No. 4,367,989 to Smith discloses a portable gold mining apparatus collecting particulate gold bearing material from rock crevices. The apparatus includes a gas engine driven air blower having shoulder straps for mounting on the back of a user. The air blower includes flexible duct connected to an elongated flexible conduit having a nozzle or crevice tool connected to the conduit front end and a container having an air outlet connected to the rear end of the conduit. The air blown into the conduit provides jet pump action to suck particulate gold bearing material to the container from the conduit front end. However, unlike the present invention, both the Smith and Temple apparatuses utilize pressurized air for sucking the medium rich in particulate matter.

U.S. Pat. No. 2,073,122 to Silke discloses a portable placer mining device designed to be operated on the bed of stream or river to recover valuable minerals such as gold, silver and platinum. The device doesn't use power and is adapted to be anchored in the river or stream. The device utilizes water current to create sufficient suction to draw sand and gravel from the river or stream into a sluice box. The flow of the water washes sand and gravel through the sluice box provided with riffles or matting for trapping valuable minerals and the sand and gravel is carried back to the stream. However, the means for collecting the particulate matter and the structure associated for creating suction in the present invention are different.

Gold mining apparatuses typically use motors to create suction pressure for sucking the medium rich in particulate, making them cumbersome and expensive. It is therefore an object of the present invention to provide a non-motorized gold mining apparatus that is significantly lighter, smaller and less expensive to operate.

A further object is to provide a non-motorized gold mining apparatus which has no moving parts that are sensitive to extreme temperatures and corrosion. These and other objects of the present invention will become better understood with reference to the appended Summary, Description, and Claims.

SUMMARY

The present invention is a non-motorized mining apparatus for extracting gold and other valuable minerals from stream placer deposits. The apparatus comprises three tubular members, fibrous matting and a skirt made of non-permeable and flexible fabric for enveloping the tubular members. One of the ends of the first tubular member is connected to the second tubular member. The second tubular member is designed in a way to create a space with venturi forces at its interface with the first tubular member. The fibrous matting is disposed over the third tubular member with perforated ridges for trapping the particulate matter. The assembly of the third tubular member and the outer layer of fibrous matting is held entirely inside the second tubular member. The skirt is clamped at one end and left unclamped at the other end for receiving the stream flow.

The other end of the second tubular member is connected to a flexible hose. Because of the venturi-like space, stream enters the first tubular member with high velocity causing a suction pressure in the second tubular member. Stream is sucked into the second tubular member and the flexible hose due to the suction pressure. The particulate matter carried by the stream gets collected in the fibrous matting. The particulate matter can be extracted by detaching the tubular members and fibrous matting.

FIGURES

Reference Numerals

10 . . . Apparatus of the Present Invention
12 . . . First Tubular Member
14 . . . Second Tubular Member
16 . . . Third Tubular Member
18 . . . Fibrous Matting
20 . . . Groove
22 . . . Venturi-like Space
24 . . . Skirt
26 . . . Ridge
28 . . . Perforation

30 . . . End Cap
32 . . . Flexible Hose
34 . . . Nozzle

DETAILED DESCRIPTION

Figure 1:
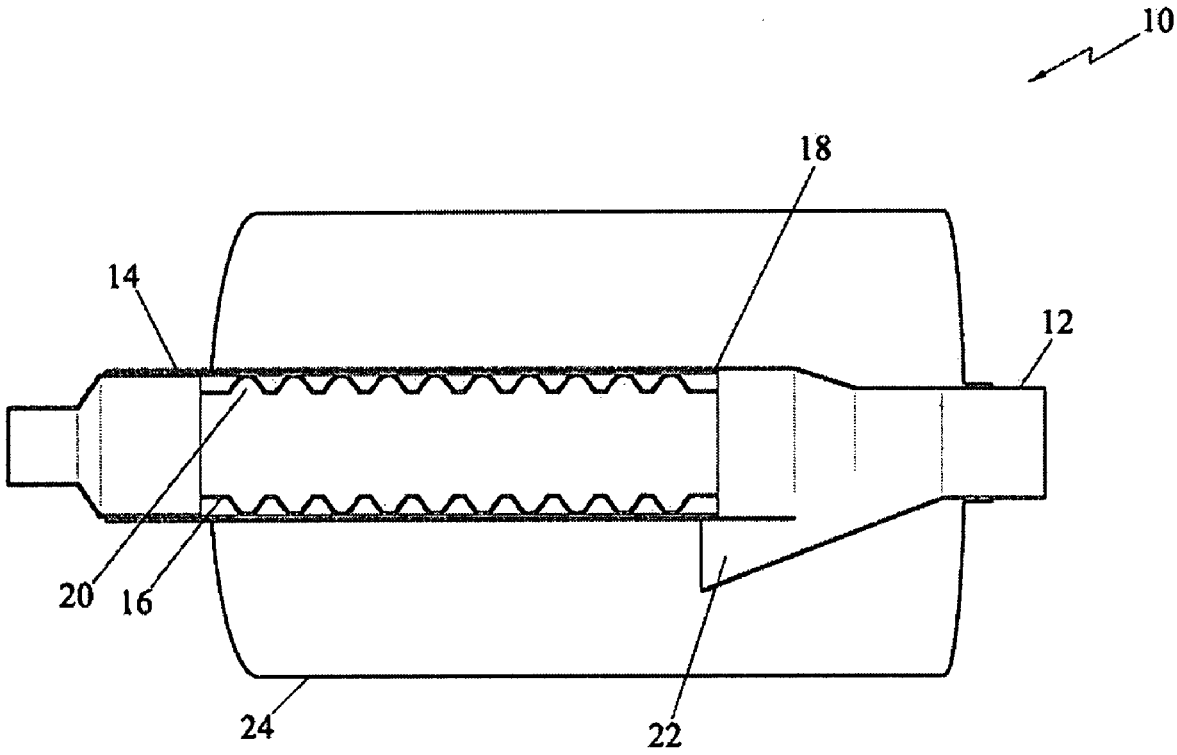
FIG. 1 is a cross-sectional view of the non-motorized gold mining apparatus of the present invention.
Figure 2:
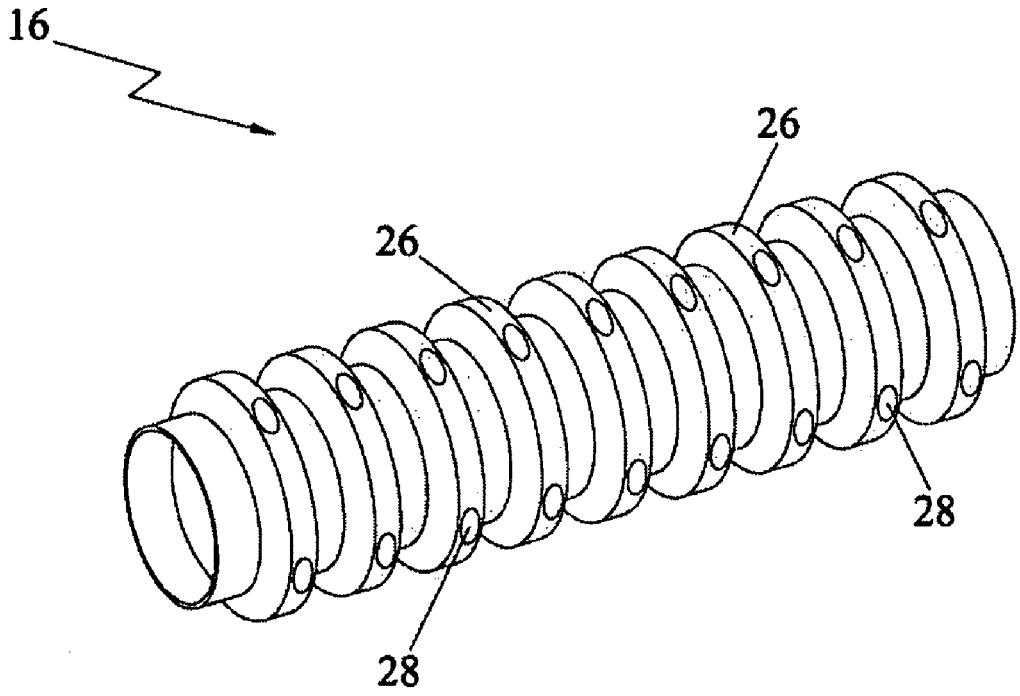
FIG. 2 is a perspective view of the third tubular member.
Figure 3:
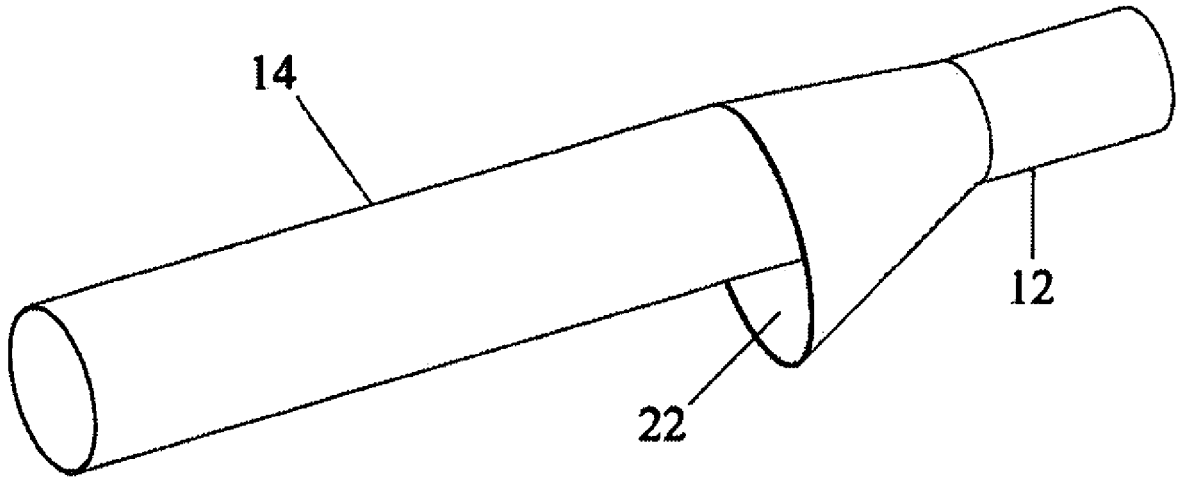
FIG. 3 is a perspective view of the first and second tubular members.
Figure 4:
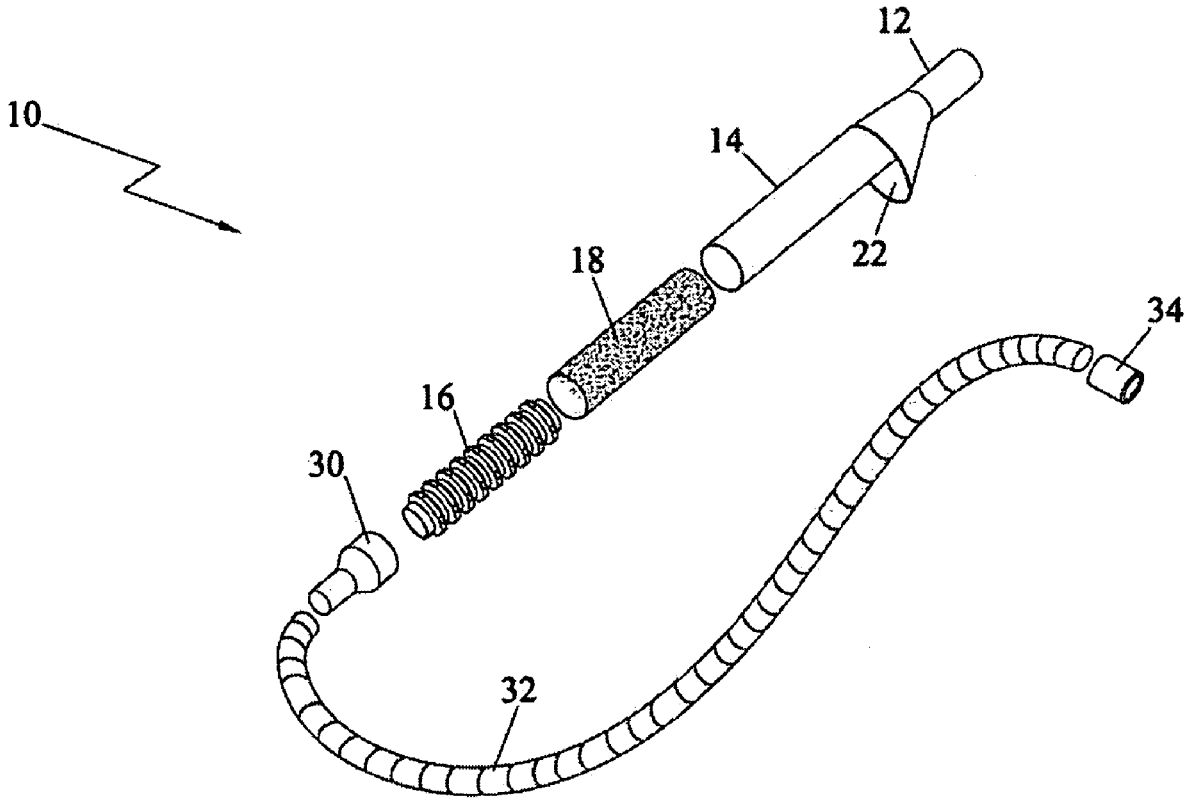
FIG. 4 is an exploded view of the apparatus, without the skirt.

Referring to the drawings, a preferred embodiment of a non-motorized gold mining apparatus is illustrated and generally indicated as 10 in FIGS. 1 through 4. The apparatus 10 of the present invention is used for mining gold in stream placer deposits.

Referring to FIGS. 1 through 4, the non-motorized gold mining apparatus 10 comprises a first tubular member 12, a second tubular member 14, a third tubular member 16, a fibrous matting 18, and a skirt 24 for enveloping the tubular members. All the tubular members are made of rigid material. The first tubular member 12 includes a conical section open at both the ends and a uniform section with constant diameter extending from the narrower end of the conical section. The second tubular member 14 is of uniform cross-section.

The broader end of the conical section is connected to one end of the second tubular member 14 leaving a venturi-like space 22 between the inner surface of the broader end of the conical section and the outer surface of the second tubular member 14. The first 12 and the second 14 tubular members can be detachably connected. A flexible hose 32 is connected to the other end of the second tubular member 14 through an end cap 30. A nozzle 34 is provided at the other end of the flexible hose 32.

The third tubular member includes ridges over its exterior surface. The ridges 26 form grooves 20 on the inner surface of the third tubular member 16. The third tubular member 16 also includes a plurality of perforations 28 on its ridges. The fibrous matting 18 is disposed over the third tubular member. The third tubular member 16 with the outer layer of fibrous matting 18 is securely held entirely inside the second tubular member 14.

The skirt 24 for enveloping the tubular members is made of a non-permeable and flexible fabric, which is clamped by a hose clamp to the uniform tubular section of the first tubular member and is left unclamped at the other end for receiving the flow of stream. The skirt 24 directs the stream into the first tubular member 12.

The apparatus is placed in the stream such that the volume of water entering is greater than the water leaving the skirt 24. The apparatus is anchored in place with ropes. Because of the stream flow through the skirt 24, and positive buoyancy the apparatus will seek an optimum position parallel to the stream just below the water level.

The skirt 24 directs the stream to the first tubular member 12. The velocity of stream entering the first tubular member is increased due to the venturi-effect created by the venturi-like space 22. This increase in velocity in the first tubular member 12 creates a suction pressure in the second tubular member 14. The stream is sucked into the second tubular member 14 and the flexible hose 32 due to the suction pressure.

The water sucked into the second tubular member 14 passes over the ridges 26 of the third tubular member 16. The particulate matter having higher specific gravity settle in the grooves 20 and passes through the plurality of perforations 28 to get trapped in the fibrous matting 18. The remaining sand and gravel is washed back to the stream through the first tubular member 12. The particulate matter can be extracted after disconnecting the tubular members and removing the fibrous matting from the second tubular member 14. The particulate matter is then extracted from the third tubular member 16 and the fibrous matting 18.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, paragraph 6. In particular, the use of "step of" in the claims herein is not intended to invoke the provisions of 35 U.S.C. § 112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A non-motorized apparatus for collecting particulate materials, including gold, in stream placer deposits, comprising:

a. a first tubular member with a first inlet, a second inlet, and an outlet;

b. a second tubular member attached at the second inlet of the first tubular member such that a high velocity stream flowing through the first inlet of the first tubular member creates a suction pressure in the second tubular member;

c. a third tubular member disposed in the second tubular member and configured to selectively retain particulate matter of a predetermined specific gravity; and d. a skirt enveloping the first, second and third tubular members and directing stream flow into the first tubular member.

2. The apparatus of claim 1, wherein the first inlet of the first tubular member comprises a conical section, and the outlet comprises a uniform tubular section having a constant diameter.

3. The apparatus of claim 2, wherein the first end of the second tubular member forms a venturi effect inducing space between the outer surface of the second tubular member and the inner surface of the first inlet of the conical section.

4. The apparatus of claim 3 wherein the second tubular member is detachably connected to the second inlet.

5. The apparatus of claim 3, wherein the end of the second tubular member opposite the first tubular member is connected to a flexible hose.

6. The apparatus of claim 3, wherein the stream enters the first tubular member through the venturi-like space, which increases the velocity of the stream and creates the suction pressure in the second tubular member.

7. The apparatus of claim 1, wherein the skirt for enveloping the tubular members comprises a non-permeable and flexible fabric.

8. The apparatus of claim 7, wherein one end of the skirt is attached to the uniform tubular section of the first tubular member and is unattached at the other end of the skirt to receive stream flow.

9. The apparatus of claim 1, wherein the third tubular member comprises ridges and a fibrous matting on the outer layer of the third tubular member, the ridges include perforations and form grooves on the inner surface of the third tubular member.

10. The apparatus of claim 9, wherein the fibrous matting, first, second and third tubular members are detachable.

11. The apparatus of claim 10, wherein the third tubular member and the fibrous matting are securely held entirely inside the second tubular member.

12. The apparatus of claim 1, wherein the particulate matter having a higher specific gravity settles and is collected on the means for trapping the particulate matter.

13. The apparatus of claim 1, wherein particulate matter can be extracted by detaching the first and second tubular members and the means for trapping the particulate matter.

14. A non-motorized gold mining apparatus for collecting particulate matter, including gold in stream placer deposits comprising:

a. a first tubular member having a conical section with open ends and a uniform section extending from the narrower end of the conical section;

b. a second tubular member attached to one end of the first tubular member in a way to create a Venturi effect inducing space between the outer surface of the second tubular member and the inner surface of the broader end of the conical section, wherein a high velocity stream flowing into the first tubular member creates a suction pressure in the second tubular member, thereby drawing the stream into the second tubular member;

c. a skirt made of non-permeable and flexible fabric for enveloping the tubular members and allowing the stream flow into the first tubular member;

d. a third tubular member with ridges and a plurality of perforations on the ridges, the ridges forming grooves on the inner surface of the third tubular members; and e. a fibrous matting over the third tubular member for trapping the particulate matter, wherein the fibrous matting and the third tubular member are securely held entirely inside the second tubular member.

15. The apparatus of claim 14, wherein the flexible hose with a nozzle at one end is connected to the second tubular member at the other end, the stream drawn into the second tubular member flows in through the flexible hose and out through the first tubular member.

16. The apparatus of claim 14, wherein particulate matter having a higher specific gravity settles in the grooves of the third tubular member, passes through the perforations and gets trapped into the fibrous matting.

17. The apparatus of claim 14, wherein the particulate matter can be extracted by detaching the fibrous matting and the first, second and third tubular members.

* * * * *